United States Patent [19]

Mikesell

[11] Patent Number: 4,875,591

[45] Date of Patent: Oct. 24, 1989

[54] MARKING BOARD IMPLEMENT HOLDER

[75] Inventor: Jerome J. Mikesell, Chicago, Ill.

[73] Assignee: M. Manufacturing Services, Inc., Chicago, Ill.

[21] Appl. No.: 238,992

[22] Filed: Aug. 31, 1988

Related U.S. Application Data

[63] Continuation of Ser. No. 939,180, Dec. 8, 1986, abandoned.

[51] Int. Cl.[4] ..... A47F 7/00

[52] U.S. Cl. ..... 211/69.1; 211/88

[58] Field of Search ..... 211/69.1, 60.1, 69.5, 211/89, 67, 68, 69, 69.8, 70.8, 71, 88, 89, 126; 248/205.3

[56] References Cited

U.S. PATENT DOCUMENTS

| | | | |
|---|---|---|---|
| 67,120 | 7/1867 | Jedamski | 211/69 X |
| 1,889,146 | 11/1932 | Kalenoff | 211/41 x |
| 3,627,182 | 12/1971 | Calkins | 248/205.3 X |
| 3,800,974 | 4/1974 | Mogel et al. | 211/69.1 X |
| 4,415,092 | 11/1983 | Boyer | 211/59.2 X |

FOREIGN PATENT DOCUMENTS

| | | | |
|---|---|---|---|
| 63376 | 3/1913 | Switzerland | 211/69.8 |
| 341404 | 11/1959 | Switzerland | 211/69 |

*Primary Examiner*—Sarah A. Lechok

[57] ABSTRACT

A one-piece molded holder is provided for dry erase markers, erasers, chalk, pens, pencils, paint brushes and the like. The holder has a peripheral sidewall and a wall therebetween having the profile or profiles of the implements to be held. A peripheral flange extends from the peripheral wall and carries an adhesive, protected by a peel-off strip, for mounting the holder to a supporting surface.

1 Claim, 1 Drawing Sheet

MARKING BOARD IMPLEMENT HOLDER

This is a continuation of application Ser. No. 939,180 filed Dec. 8, 1986 now abandoned.

BACKGROUND OF THE INVENTION

1. Field of the Invention

The present invention relates to an implement holder for marking boards, and is particularly concerned with an implement holder for dry erase boards commonly called white boards.

2. Description of the Prior Art

Chalkboards and dry erase boards are commonly used in situations where large-scale transfer of information is required. The markers and erasers used in conjunction with such boards are generally kept on horizontal ledges affixed directly beneath the boards. The use of ledges to maintain an orderly control of markers and erasers has notable disadvantages. First of all, the ledges are typically too narrow to adequately retain erasers. As a result, erasers regularly fall to the floor. Also, ledges form protruding corners which can cause clothing to be caught and damaged and, at times, injury can result from brushing against short corners. Finally, ledges act to catch and retain debris resulting from erasure, in addition to the normal build up of dust found on interior horizontal surfaces.

A variety of boards no longer incorporate ledges. In such instances there is no provision for the placement and access of chalk, markers or erasers. Users are sometimes forced to walk away from the board in order to retrieve or lay down one of these implements.

SUMMARY OF THE INVENTION

The object of the present invention is to organize and provide immediate access to markers and erasers.

The above object is achieved, according to the present invention, in that a holder is provided which comprises a number of partial cylindrical cavities for retaining respective markers and a separate, trapezoidal cavity to retain an eraser. All cavities are dimensioned such that markers and erasers are frictionally restrained within the cavities.

Additionally, the dimensions of the cavity are established such that the magnitude of the resisting force does not exceed 5 lbf during removal of markers or erasers. The lengths of the cavities are set so as to encourage removal of markers and/or erasers from either end. This structure eases removal and permit ambidextrous use. The erasure cavity includes at least one, preferably two, small holes which act to equalize the pressure differential induced during removal of the eraser from the holder.

According to a particular feature of the invention, the holder incorporates a flat peripheral flange which has a double faced adhesive tape connected thereto with a peel-off layer for affixing the holder to a supporting surface.

Although the holder is intended for use with white board markers and erasers, such as the EXPO$^R$ erasers and markers manufactured by Sandford Corp. Bellwood, IL, the holder can also be dimensioned for conventional chalk and blackboard erasers, pens, pencils, paint brushes and the like.

BRIEF DESCRIPTION OF THE DRAWING

Other objects, features and advantages of the invention, its organization, construction and operation will be best understood from the following detailed description, taken in conjunction with the accompanying drawing, on which

DESCRIPTION OF THE PREFERRED EMBODIMENTS

Figure 1:
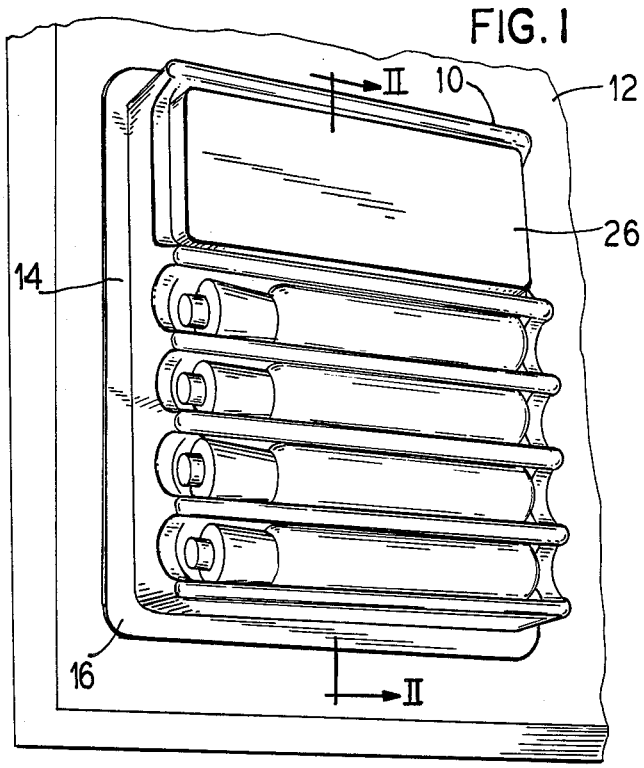
FIG. 1 is a pictorial representation of a holder, constructed in accordance with the present invention, shown mounted on a supporting surface.

Referring to FIG. 1, an implement holder is generally illustrated at 10 as being supported by a surface 12. The vertical orientation selected here relates to the aformentioned type of dry erase markers in which the marker must be maintained in a horizontal orientation to prevent ink transfer out of or away from the felt tip.

As shown in FIG. 1, the holder comprises a peripheral and continuous sidewall 14 having a peripheral flange 16 extending therefrom. As is evident from FIGS. 1 and 2, the holder 10 is thermoformed or injection-molded product of any suitable thermoplastic and incorporates draft angles ranging from between 1 and 2° to allow release from the forming tool during fabrication.

Figure 2:
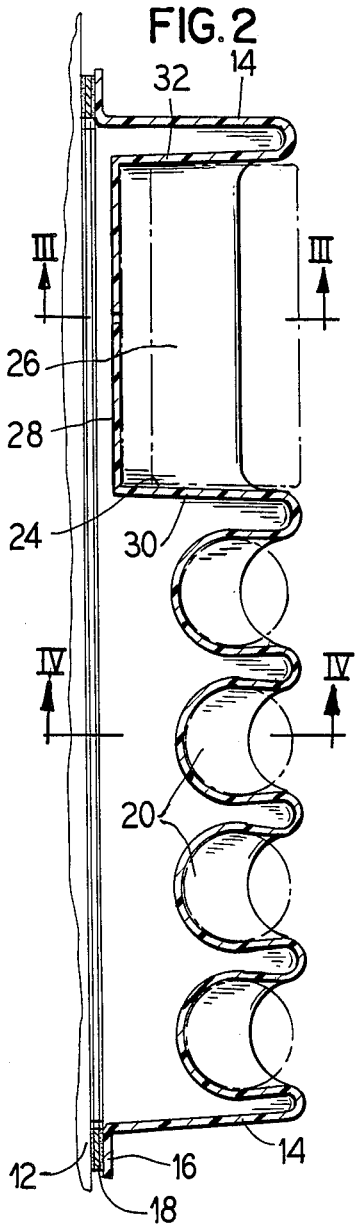
FIG. 2 is a sectional view taken substantially along the line II—II of FIG. 1.

Referring to FIGS. 1 and 2, the holder comprises a plurality of arcuate cavities 20 for receiving respective markers 22 and a cavity 24 for receiving an eraser 26. The cavity 24 has a trapezoidal cross section (shown flexed in FIG. 2) for frictional retention of an eraser 26.

Figure 3:
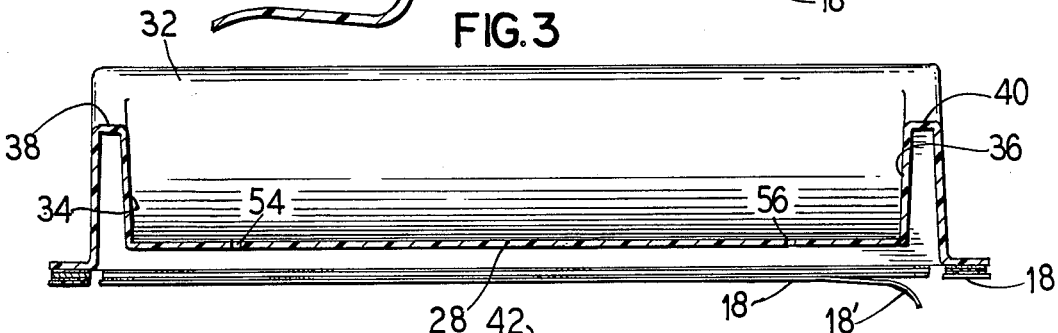
FIG. 3 is a sectional view taken substantially along the line III—III of FIG. 2.

Referring to FIGS. 2 and 3, the cavity 24 is formed to comprise a floor 28 and a plurality of walls 30, 32, 34 and 36. As best seen in FIG. 3, the cavity 24 comprises a pair of recesses 38 and 40 for hand access to the ends of the eraser 26.

Figure 5:
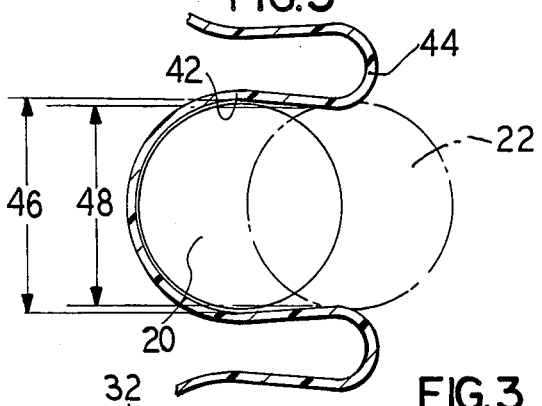
FIG. 5 is an enlarged fragmentary sectional view of a variation of one of the marker cavities of FIG. 2.
Figure 4:
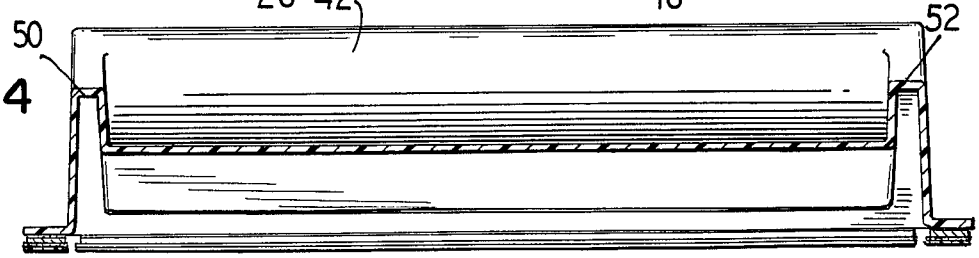
FIG. 4 is a sectional view taken substantially along the line IV—IV of FIG. 2.

Referring to FIGS. 4 and 5, the cavities 20 are illustrated as being formed by an arcuate wall 42 which is joined to an adjacent cavity, to the wall 30 or to the peripheral wall 14, respectively, by way of an arcuate section 44. As best seen in FIG. 5, a marker 22 has a predetermined maximum diameter 46 which is slightly greater than the normally unflexed diameter 48 of the arcuate wall 42 so that there is a yieldable, bypassing relationship of the marker 22 into the cavity 20 so that the marker is retained in the cavity. As best seen in FIG. 4, each of the cavities 20 is provided with a hand access recess 50, 52 at each end thereof to facilitate removal of a marker. In FIG. 2, the walls of the cavity are straight and tend to close about an inverted marker.

Referring to FIGS. 2 and 3, the peripheral edge is provided with a plurality of double-back adhesive strips 18 each of which includes a peel-off strip 18' which, when removed, permits affixation of the holder to a supporting surface, such as the supporting surface 12.

Inasmuch as the cavity 24 for receiving the erasure 26 may be dimensioned for a close peripheral fit with respect to the erasure, it may be advisable, as illustrated in FIG. 3, to provide a plurality of holes 54, 56 to equalize the pressure differential which is induced during removal of the eraser from the holder.

Although I have described my invention by reference to particular illustrative embodiments thereof, many changes and modifications of the invention may become apparent to those skilled in the art without departing from the spirit and scope of the invention. I therefore intended to include within the patent warranted hereon all such changes and modifications as may reasonably and properly be included within the scope of my contribution to the art.

I claim:

1. A holder for releasably holding first and a plurality of second marking board implements each of which has a length and predetermined cross-sectional dimensions, comprising:

a one-piece molded plastic structure including a planar rectangular peripheral flange;

adhesive strips affixed to said flange for mounting said holder to a support;

peel-off strips on and protecting said adhesive strips;

an outer wall extending a predetermined distance from and perpendicular to the plane of said peripheral flange, said outer wall comprising first and second parallel, spaced outer wall sections and third and fourth parallel spaced outer wall sections perpendicular to said first and second outer wall sections;

an inner wall extending between and connected to said first, second, third and fourth outer wall sections;

said inner wall comprising first, second and third inner wall sections extending parallel to said first outer wall section, said third inner wall section connecting said first and second inner wall sections and together therewith forming a first cavity for receiving the first marking board implement, said first and second inner wall sections extending convergent towards one another in the direction of said third inner wall section to provide a snug fit for the first marking board implement and dimensioned to prevent easy removal of the first marking board implement;

a plurality of fourth inner wall sections, extending parallel to one another and serially connected together between said second inner wall section and said second outer wall section, each of said fourth inner wall sections forming a cavity for receiving a respective second marking board implement and being substantially of U-shaped cross-section and including resilient portions spaced less than the predetermined cross-sectional dimensions of the second marking board implements for yieldable bypassing of the rspective second marking board implement, said fourth inner wall sections being dimensioned to provide depths for each of the cavities which together with said resilient portions prevents easy removal of a respective second marking board implement; and end portions connecting said third and fourth outer wall portions to said inner wall at locations adjacent the marking board cavities and at distances less than said predetermined distance from said peripheral flange to provide access to and easy removal of the marking board implement and wherein said pressure relief means comprises: at least one hole through said third wall section.

* * * * *